United States Patent [19]

Nidecker

[11] 4,148,500

[45] Apr. 10, 1979

[54] SKI WITH GRIPPING DEVICE

[76] Inventor: Henri P. Nidecker, Place de l'Industrie 2, 1180 Rolle, Vaud, Switzerland

[21] Appl. No.: 859,877

[22] Filed: Dec. 12, 1977

[30] Foreign Application Priority Data

Dec. 21, 1976 [CH] Switzerland ..... 16122/76

[51] Int. Cl.[2] ..... A63C 5/04

[52] U.S. Cl. ..... 280/604; 280/609

[58] Field of Search ..... 280/604, 609

[56] References Cited

U.S. PATENT DOCUMENTS 2,287,252 6/1942 Kaufmann ..... 280/604

FOREIGN PATENT DOCUMENTS 811203 8/1951 Fed. Rep. of Germany ..... 280/604
810162 4/1936 France ..... 280/604
916620 10/1945 France ..... 280/604
2301274 2/1975 France ..... 280/604
270867 3/1949 Switzerland ..... 280/604

*Primary Examiner*—John A. Pekar
*Assistant Examiner*—Gene A. Church
*Attorney, Agent, or Firm*—Stevens, Davis, Miller & Mosher

[57] ABSTRACT

A ski, more particularly a cross-country ski, provided with a gripping device fixed in a longitudinal slot located in the sole of the ski, comprising an undetachably fixed, substantially U-shaped element and a substantially parallelipipedic element fixed detachably in the opening aperture of the U-shaped element and offering one smooth longitudinal surface and a brush or other retention system on the opposite longitudinal surface, the whole in such a way that the detachable element can be affixed either with its smooth surface flush with the sole of the ski or in an inverse position in which the brush protrudes beyond the sole of the ski.

3 Claims, 1 Drawing Figure

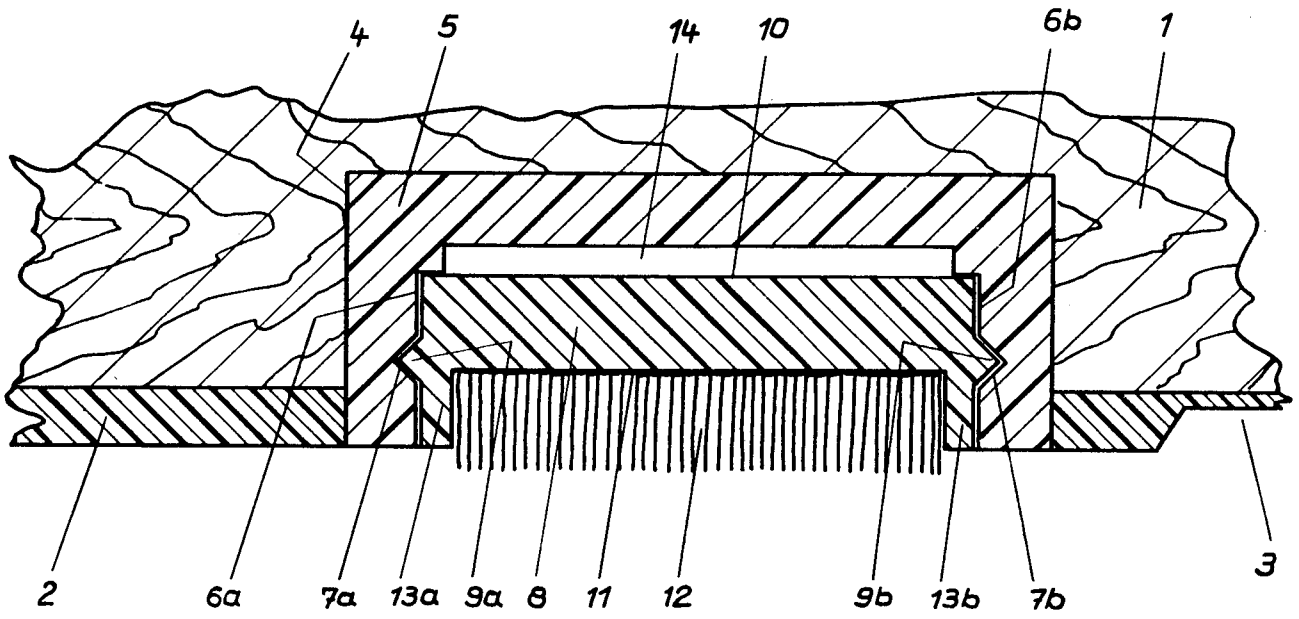
1
6b
10
14
5
4
3
7b
13b
9b
12
11
8
9a
13a
7a
6a
2

SKI WITH GRIPPING DEVICE

The present invention concerns a ski, more particularly a cross-country ski, provided with a gripping device fixed in a longitudinal slot located in the sole and body of the ski.

Skis equipped with gripping devices such as sealskins or imitations thereof in synthetic materials applied to the soles of the skis are already known. The application of natural or synthetic skins has the disadvantage of imperfect adherence. Moreover, when removing the adhered skin, a part of the adhesive material may remain on the ski sole, thus preventing good sliding. In order to overcome this latter disadvantage, the sticking of strips of gripping skin in longitudinal grooves has already been suggested. This gives rise to another disadvantage, viz. the sole no longer provides a sufficiently large, smooth surface after the adhesive skin has been removed.

In addition, the fixing of permanent and undetachable gripping devices to ski soles is also known. These devices cause excessive resistance during downhill skiing.

The object of the present invention is to overcome these disadvantages and to make available to skiers a ski equipped with an efficient gripping device which can be easily transformed so as to rapidly obtain a ski having a perfectly smooth sole for downhill skiing, and which may be waxed.

In order to achieve this object, the ski according to the invention comprises a substantially U-shaped element undetachably fixed in this slot and a parallelipipedic element detachably fixed in the aperture of the U-shaped element and offering one smooth, longitudinal surface and a brush or other retention system on the other longitudinal surface, the whole in such a way that the detachable element can be fixed either with its smooth surface flush with the sole of the ski or in the inverse position in which the brush protrudes beyond the sole of the ski.

It is advantageous to provide a longitudinal groove located in each of the inner walls of the U-shaped element, and a longitudinal projection located on each lateral wall of the detachable element and fitting into the longitudinal groove, in order to retain the detachable element by friction.

The attached drawing shows a cross-section of a special embodiment of the ski according to the invention.

The ski illustrated comprises a body 1 in wood or in a synthetic material reinforced with fiberglass, a sole 2 in polyethylene or in polytetrafluorethylene and a central groove 3 of the known type indicating a longitudinal symmetrical axis (the right hand part of the cross-section is not shown).

A longitudinal slot 4 is provided in the sole 2 and the body 1. A U-shaped element 5 which may consist of a known synthetic material is fixed in this slot. In each of its inner walls 6*a* and 6*b* a longitudinal groove 7*a* and 7*b*, respectively, is provided.

A substantially parallelipipedic element 8 having a longitudinal projection 9*a* and 9*b*, respectively, on its lateral walls is detachably fixed in the element 5. The element 8 is provided with one smooth, longitudinal surface 10 and its other longitudinal surface 11 is equipped with a brush 12. The width of the brush 12 is limited by two parts of the longitudinal walls 13*a* and 13*b*, respectively, having a certain flexibility. The brush 12 may consist of long-piled plush of the "Mohair" variety or another type of retention sole.

In order to remove the element 8, it is slid longitudinally until one tip protrudes beyond one extremity of the ski, whereupon the parts 13*a* and 13*b* are lightly squeezed. At this point it is possible to disengage the projections 9*a* and 9*b* from the grooves 7*a* and 7*b*, respectively. If the ski is to be prepared for downhill skiing, the element 8 is inverted by squeezing the parts 13*a* and 13*b* and by sliding the projections 9*a* and 9*b* into the grooves 7*a* and 7*b* respectively. Thus the smooth surface 10 will be flush with the sole 2. The exterior part of the brush 12 will then be located within the empty space 14.

Obviously, it would be possible to have several longitudinal projections with corresponding grooves in the place of a single projection 9 with a single corresponding groove 7.

What is claimed is:

1. A ski having a longitudinal slot in its underface, means fixed in said slot and defining a cavity with a mouth at the plane of the underface of the ski, a parallelepipedic element having one smooth face and an opposite face having a retentive surface, means detachably to mount said element in said cavity with one of said faces in a position to form a part of the underface of the ski and the opposite face housed within said cavity.

2. A ski as claimed in claim 1 in which the mounting means comprise pairs of complementary longitudinally extending grooves and projections, one of each pair being a part of the means defining said cavity and its complement being a part of said parallelepipedic element.

3. A ski as claimed in claim 2 wherein said retentive face is comprised of a brush housed in said element, the width of said brush being less than the width of said element and being so positioned as to leave side margins of the element between the side of the brush and the outer side face of the element, said margins being made of a flexible material.

* * * * *